US009873970B2

(12) United States Patent
Shin et al.

(10) Patent No.: US 9,873,970 B2
(45) Date of Patent: Jan. 23, 2018

(54) METHOD FOR CONTROLLING WASHING MACHINE

(71) Applicant: LG ELECTRONICS INC., Seoul (KR)

(72) Inventors: Hyosang Shin, Seoul (KR); Baekgeun Ji, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 15/312,723

(22) PCT Filed: Jul. 2, 2015

(86) PCT No.: PCT/KR2015/006842
§ 371 (c)(1),
(2) Date: Nov. 21, 2016

(87) PCT Pub. No.: WO2016/003227
PCT Pub. Date: Jan. 7, 2016

(65) Prior Publication Data

US 2017/0191204 A1 Jul. 6, 2017

(30) Foreign Application Priority Data

Jul. 3, 2014 (KR) ..... 10-2014-0082932

(51) Int. Cl.
*G08B 21/00* (2006.01)
*D06F 39/00* (2006.01)
*D06F 33/02* (2006.01)

(52) U.S. Cl.
CPC ..... *D06F 39/003* (2013.01); *D06F 33/02* (2013.01); *D06F 39/005* (2013.01);
(Continued)

(58) Field of Classification Search
CPC ..... D06F 39/003; D06F 39/005; D06F 33/02; D06F 2210/00; D06F 2202/10; D06F 2212/02
(Continued)

(56) References Cited

U.S. PATENT DOCUMENTS 4,862,710 A * 9/1989 Torita ..... D06F 39/003 68/12.01
2007/0261713 A1 11/2007 Choi et al.
(Continued)

FOREIGN PATENT DOCUMENTS

JP 2005-185460 7/2005
KR 10-0245423 2/2000

OTHER PUBLICATIONS

International Search Report and Written Opinion in International Application No. PCT/KR2015/006842, dated Oct. 6, 2015, 8 pages.

*Primary Examiner* — Dhaval Patel
(74) *Attorney, Agent, or Firm* — Fish & Richardson P.C.

(57) ABSTRACT

A method is provided for controlling a washing machine including a control panel, a wireless communication module transmitting and receiving a signal through the internet, a driving unit including a driving motor, and a controller controlling an operation of the driving unit. The method includes, storing in the controller washing condition information including laundry weight information for washing, a laundry weight detection period or time, and active washing or not, counting a period or time for detecting the laundry weight, detecting a current laundry weight when the laundry detection period or time arrives, and transmitting a message notifying that the current laundry weight reaches a preset laundry weight to a server for washing control application through the internet, when the current laundry weight reaches the preset laundry weight.

18 Claims, 5 Drawing Sheets

(52) U.S. Cl.
CPC ..... *D06F 2202/10* (2013.01); *D06F 2210/00* (2013.01); *D06F 2212/02* (2013.01)

(58) Field of Classification Search
USPC ..... 340/666, 5.7, 12.54, 568.1; 8/137, 158, 8/159; 68/12.01, 12.02, 12.04, 12.27; 700/282, 291
See application file for complete search history.

(56) References Cited

U.S. PATENT DOCUMENTS

| | | | |
|---|---|---|---|
| 2013/0042416 | A1 | 2/2013 | Balinski et al. |
| 2014/0085046 | A1 | 3/2014 | Shin et al. |

* cited by examiner

【Figure 1】
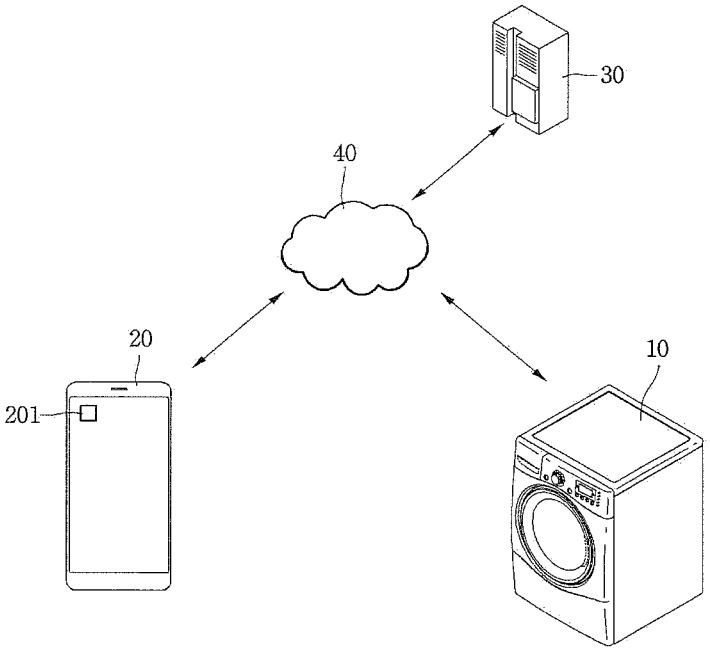

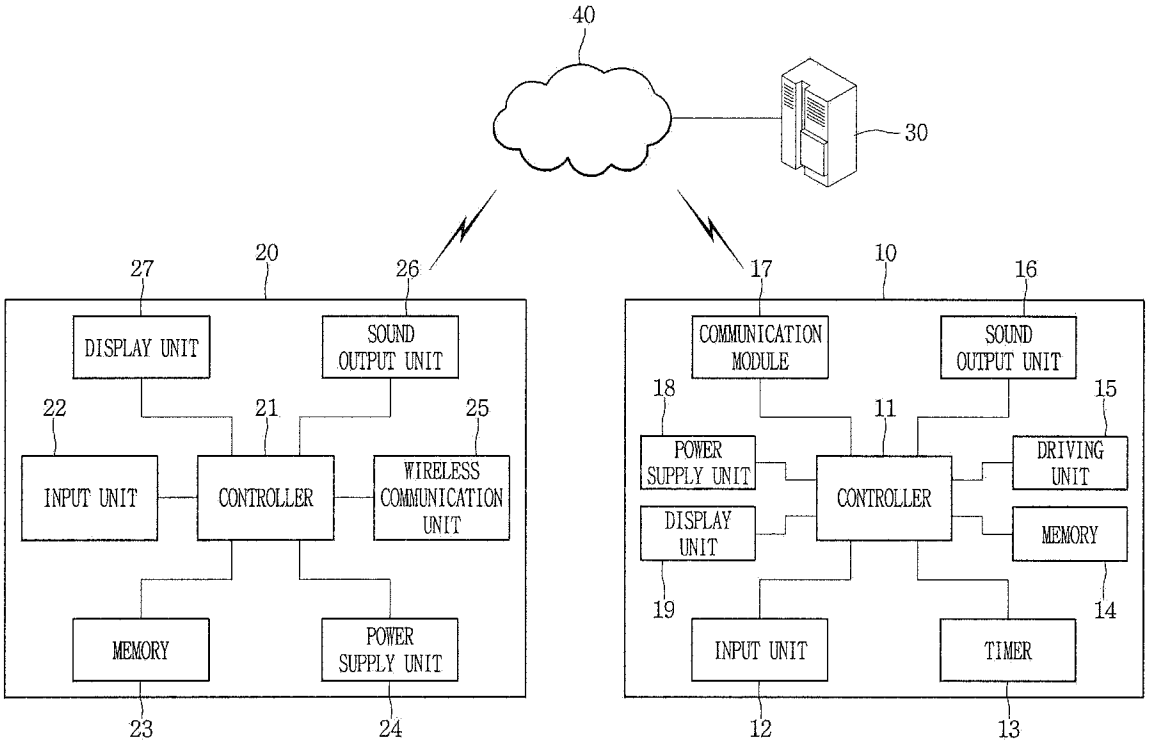
[Figure 2]

【Figure 3】
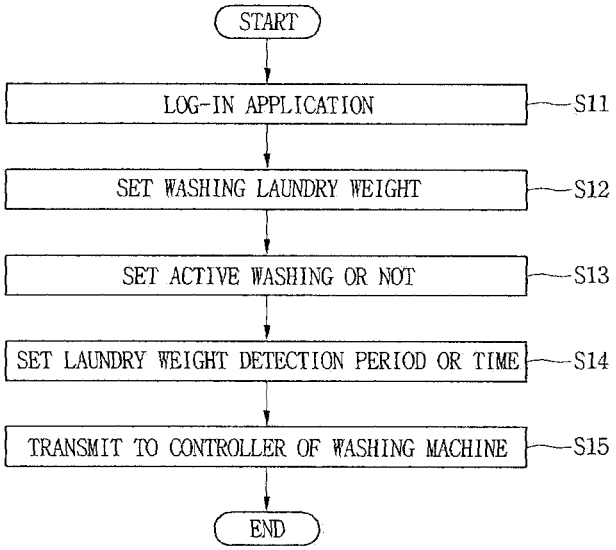

【Figure 4】
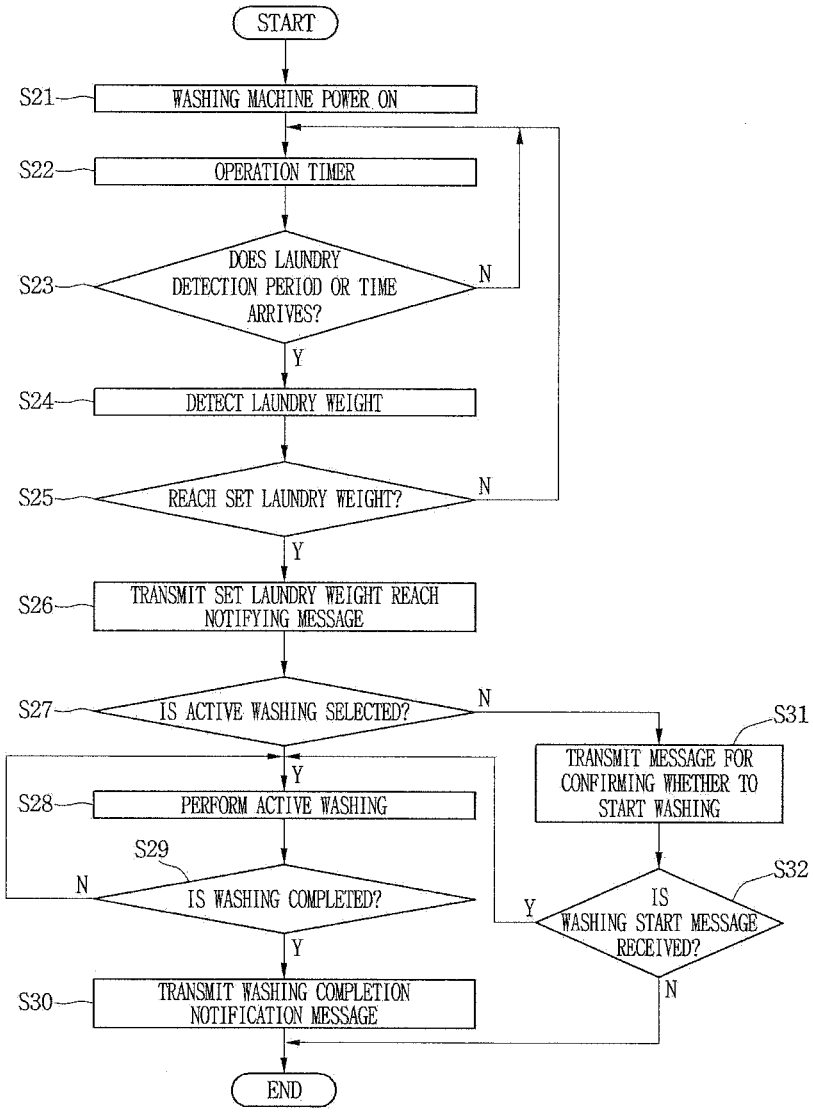

【Figure 5】
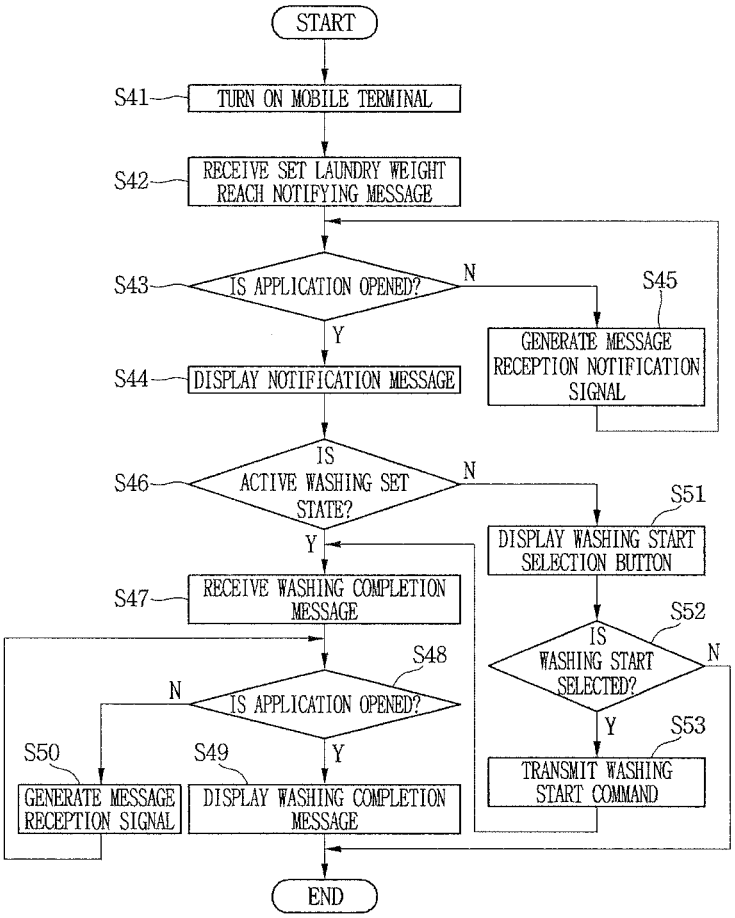

METHOD FOR CONTROLLING WASHING MACHINE

CROSS REFERENCE TO RELATED APPLICATIONS

This application is a U.S. National Phase Application under 35 U.S.C. §371 of International Application PCT/KR2015/006842, filed on Jul. 2, 2015, which claims the benefit of Korean Application No. KR 10-2014-0082932, filed on Jul. 3, 2014, the entire contents of which are hereby incorporated by reference in their entireties.

TECHNICAL FIELD

The present disclosure relates to a method for controlling a washing machine.

BACKGROUND ART

Typically, for doing the wash by using a washing machine, laundries and a detergent are put into the washing machine, a washing course is set, and then a washing start button is pressed to run the washing machine. However, there are many cases where busy contemporaries miss a washing chance, and where doing the wash at once on weekend rather than several times on weekdays. In particular, when a laundry weight is not periodically checked, the washing chance is apt to be missed, and when the laundry is excessively piled up, washing takes a long time. In addition, since the washing is not timely done, there are many cases of knowing that the washing is not done at the time of going to school or going to work.

DISCLOSURE

Technical Problem

Embodiments provide a method for controlling a washing machine.

Technical Solution

In one embodiment, a method is provided for controlling a washing machine comprising a control panel, a wireless communication module configured to transmit and receive a signal through the internet, a driving unit having a driving motor, and a controller configured to control an operation of the driving unit, the method comprising: storing in the controller washing condition information comprising laundry weight information for washing, a laundry weight detection period or time, and active washing information; counting the period or time for detecting the laundry weight; based on lapse of the laundry detection period or time, detecting a current laundry weight; and based on the current laundry weight reaching a preset laundry weight, transmitting, through the internet to a server for a washing control application, a message notifying that the current laundry weight has reached the preset laundry weight.

The details of one or more embodiments are set forth in the accompanying drawings and the description below. Other features will be apparent from the description and drawings, and from the claims.

Advantageous Effects

According to a method for controlling a washing machine, first, since the laundry weight is periodically checked and a washing chance is notified to a user when it approaches, cases of missing the washing chance do not frequently occur.

Second, when the washing chance is arrived, even though distant away from the house, the user may immediately transmit a washing start command remotely through a mobile terminal and the washing may be timely done.

Third, even when the user does not carefully check the laundry weight, since the user is notified of the laundry weight through his/her mobile terminal, user's convenience increases.

DESCRIPTION OF DRAWINGS

FIG. 1 illustrates a configuration for controlling a washing machine according to an embodiment.

FIG. 2 is a control block diagram of each configuration forming a control system of the washing machine of FIG. 1.

FIG. 3 is a flowchart illustrating a process for inputting a washing condition through an application of a mobile terminal according to an embodiment.

FIG. 4 is a flowchart illustrating a method for controlling a washing machine according to an embodiment.

FIG. 5 is a flowchart illustrating a method for controlling a washing machine, which is executed by a mobile terminal according to an embodiment.

BEST MODE

Reference will now be made in detail to the embodiments of the present disclosure, examples of which are illustrated in the accompanying drawings.

FIG. 1 is a system diagram illustrating a configuration for controlling a washing machine according to an embodiment, and FIG. 2 is a control block diagram of each configuration forming the control system of the washing machine of FIG. 1.

First, referring to FIG. 1, a control system of a washing machine according to an embodiment includes a washing machine 10, a mobile terminal 20 in which an application for controlling a washing machine is installed, a server 30 for managing the application 201, an the internet 40 for communication between the mobile terminal 20 and a washing machine, and between the mobile terminal 20 and the server 30.

In addition, referring to FIG. 2, the washing machine 10 may include a controller 11, an input unit 12, a timer 13, a memory 14, a driving unit 15, a sound output unit 16, a communication module 17, a power supply unit 18, and a display unit 19.

In detail, the input unit 12 may be formed in a control panel provided on the front surface of the washing machine, and provided in a touch button or press button type.

In addition, the display unit 19 is formed on the front side of the control panel and includes an LCD panel through which an image or video is output.

In addition, the timer 13 may include a clock displaying a current time as well as a timer counting a set time.

In addition, the driving unit 15 may include a driving motor rotating a washing machine drum.

In addition, the sound output unit 16 includes a warning sound, a notification signal for washing start or washing completion, or the like.

In addition, the communication module 17 may include a wired communication module including power line communication (PLC) capable of internet communication or a wireless communication module including Wi-Fi.

Furthermore, the mobile terminal 20 may include a smartphone that a user may carry, and a controller 21, an input unit 22, a memory 23, a power supply unit 24, a wireless communication unit 25, a sound output unit 26, and a display unit 27.

In detail, the input unit 22 may include a touch type button for inputting a command by touching the display unit 27.

In addition, the wireless communication unit 25 may be a mobile communication module that may communicate with the internet 40.

In addition, the sound output 26 may include a speaker.

According to the above-described configuration, the user may execute an application installed in the mobile terminal 20 for controlling a washing machine and inputting a washing machine command through the application. Then the input control command is transmitted to the server 30 for the application through the internet 40. In addition, the server 30 transmits a control command to the communication module 17 of the washing machine 10 through the internet 40.

In addition, the control command received through the communication module 17 is received by the controller 11 of the washing machine 10 and the controller 11 may control an operation of the driving unit 15 according to the received control command.

In addition, the controller 11 of the washing machine may transmit events occurring in a washing process received from the driving unit 15, timer 13, or the like through communication module 17 in a wired or wireless manner. Event information received through the communication module 17 of the washing machine 10 is transmitted to the server 30 through the internet 40. In addition, the server 30 transmits the received event information to the wireless communication unit 25 of the mobile terminal 20 through the internet 40.

In addition, the event information received by the wireless communication unit 25 may be displayed on the display unit by the controller 21 of the mobile terminal 20.

Hereinafter, a detailed description will be provided about a method for controlling a washing machine for laundry weight detection and active washing with reference to a flowchart.

Here, the active washing means that when a laundry weight of the laundry put into the washing machine drum reaches a laundry weight set for washing, even though the user does not input a washing command through the input unit 12 of the washing machine 10, the controller 11 of the washing machine 10 automatically executes a washing process.

FIG. 3 is a flowchart illustrating a process for inputting a washing condition through an application in a mobile terminal according to an embodiment.

Referring to FIG. 3, several conditions are assumed to be set for allowing laundry detection and active washing process to be executed through a washing control application installed in the mobile terminal 20.

To this end, an application main screen is activated by touching the application 201 displayed on the display unit 27. In addition, the application is logged in through an input of an ID and password. The job may also be executed in the application without an additional login. In addition, when the application 201 is installed, a job for designating the washing machine 10 having to communicate with the application 201 has to be executed. In other words, a job for pairing the user's mobile terminal 20 with the corresponding washing machine 10 may be understood as a job having a similar concept to a Bluetooth pairing job. This is for receiving the washing control command with the communication module 17 of the corresponding washing machine 10 through the internet, when the washing control command is input through the application. Hereinafter, a description is provided by assuming that a signal is set to be transmitted to the corresponding washing machine 10, when the user inputs a control command through the application 201 installed in the mobile terminal 20.

The user logs in (operation S11) to the application and then sets a washing laundry weight (operation S12).

In detail, when the application 201 is logged in, a washing laundry weight setting menu or icon for washing is displayed and the user touches the washing laundry weight setting menu. Then, the washing laundry weight may be input with a digit or as weights: large, medium, or small. In a manner for inputting the washing laundry weight with a digit, a unit thereof is set to a kg or g unit, and an integer equal to or smaller than double digits may be programmed to be input.

The washing laundry weight may mean a laundry weight of a degree that a corresponding washing machine 10 normally does washing according to a capacity of the corresponding washing machine 10, and the user may arbitrarily set the laundry weight within a washing capability range of the washing machine 10. For example, when a washing laundry weight is set small, a washing period becomes shorter, and then a washing machine is relatively frequently run. When the washing laundry weight is set large, the washing period becomes longer and then the washing machine is run in the relatively small number of times.

When the job of setting a washing laundry weight is completed, a screen of the application 201 is converted to a screen for setting active washing or not and then a process is executed for the user to determine the active washing or not (operation S13).

In detail, when the active washing is selected and it is determined that the washing laundry weight put into the washing machine drum reaches a set washing laundry weight, washing is automatically performed without asking user's intention. When the active washing is not selected, only the fact that the washing laundry weight reaches the set laundry weight is notified and the control process is terminated.

A character message such as "Do you select an option of active washing?" is output on a screen of the application 201, and a touch button for selecting "confirm", or "cancel" may be output to a lower portion thereof.

Furthermore, when the active washing setting process is completed, the screen of the application 201 is converted to a screen for setting a period or time of laundry weight detection and the user may set the period or time of laundry weight detection through a touch input.

In detail, the period of the laundry weight detection means a period that the controller 11 of the washing machine 11 operates a driving motor for detecting the laundry weight, and may be set in a unit of minute, hour, or date.

The laundry detection time means that when a specific time arrives, a laundry detection process is executed. For example, when the user sets to 6 PM and it is 6 PM, the controller 11 of the washing machine 10 transmits a laundry detection signal to the driving unit 15. Here, the laundry weight detection may be performed by employing a manner that when the washing machine drum is normally or oppositely rotated, a load of the driving motor is measured to calculate the put laundry weight. Besides, any one of laundry weight detection methods of currently released washing machines may be selected.

When the above-described conditions are set, information on the set conditions is transmitted to the controller 11 of the washing machine 10 through the internet (operation S15). Here, processes for setting the washing laundry weight, setting the active washing or not, and setting the period or time of laundry weight detection are not limited to an above-described order. In addition, the conditions may be directly input through a control panel provided in the washing machine.

FIG. 4 is a flowchart illustrating a control method of a washing machine according to an embodiment.

Referring to FIG. 4, a method for controlling a washing machine for automatic laundry weight detection and active washing is executed according to a process to be described below.

First, the washing machine is powered on and a standby state is maintained (operation S21). In addition, the timer 13 operates to calculate the period of the laundry detection weight or detect the laundry weight detection time (operation S22).

In addition, it is determined whether the period or time of the laundry detection weight arrives (operation S23). When it is determined that the period or time of the laundry detection weight arrives, the controller 11 of the washing machine 10 transmits a driving signal to the driving unit 15 to allow the driving motor to execute an operation for laundry weight detection (operation S24).

In addition, the controller 11 of the washing machine 10 determines whether the detected laundry weight reaches a laundry weight set through the application 201 (operation S25). In addition, when it is determined that the detected laundry weight reaches the set laundry weight, the controller 11 outputs a set laundry weight reach notifying message through the communication module 17. Then the output message is transmitted to the application server 30 through the internet 40 (operation S26). The set laundry weight reach notifying message may be generated in a character message type, for example, a character message such as "laundry weight put into the washing machine drum currently reaches the set laundry weight" may be transmitted. The character message may be pre-stored in the memory 14 of the washing machine 14.

Furthermore, the controller 11 of the washing machine 10 determines whether the active washing condition is selected from among setting condition information transmitted from the application server 30 (operation S27). When the active washing condition is selected, the controller 11 controls the driving unit 15 so that the notification message is transmitted and then washing is immediately done (operation S28). Here, when the user selects the active washing through the application 201, the application 201 may be programmed to further execute a process for setting a washing condition. Alternatively, when the active washing command is recognized by the controller 11 of the washing machine, the washing machine may be set that washing is done according to the washing condition set through the control panel of the washing machine 10. In addition, the detergent has to be put into a detergent box.

When the washing is completed (operation S29), the controller 11 of the washing machine 10 transmits a washing completion notifying message to the mobile terminal 20 (operation S30). The washing completion notifying message is also transmitted along the same route as a transmission route of the set laundry weight reach notifying message.

Furthermore, when the active washing is not selected, the controller 11 of the washing machine 10 transmits a washing start confirm message to the mobile terminal 20 (operation S31). In another method, when receiving the set laundry weight reach notifying message, it is also possible that the application server 30 transmits the set laundry weight reach notifying message and the washing start confirm message together to the mobile terminal 20. The washing start confirm message may be a character message such as "start washing immediately?"

In addition, when a washing start message is transmitted to the controller 11 of the washing machine 10 through the internet 40 (operation S32), the controller 11 transmits an operation signal to the driving unit 15 to allow a washing process to be executed. On the contrary, when the washing start message is not received, the control process is terminated with the transmission of the set laundry weight reach notifying message.

FIG. 5 is a flowchart illustrating a control method executed in a mobile terminal for a washing machine control according to an embodiment.

Referring FIG. 5, in order to control the laundry weight detection of laundry and active washing by using the application of the mobile terminal, the mobile terminal executes the following control process.

In detail, in a state where the automatic laundry weight detection is executed in the washing machine 10 and the mobile terminal with the application 201 installed therein is turn on (operation S41), the set laundry weight reach notifying message is received from the washing machine 10 (operation S42). As described above, the set laundry weight reach notifying message is received by the wireless communication unit 25 through the application server 30 and Internet 40.

Here, it is determined whether the application 201 is currently opened on the display unit 27 of the mobile terminal 20 by a user's touch (operation S43). When the application is opened, the received notification message is displayed on the display unit (operation S44), and when the application 201 is not opened, a message reception notification signal is generated (operation S46). The message reception notification signal may be a signal in a type of number, character, or figure notifying a message reception at a corner of an icon of the application 201, or be a notification signal output through the sound output unit 26.

Furthermore, when the active washing is selected in an initial condition setting process (operation S46), any message is not received until the washing is completed. In addition, when the washing is completed, the washing completion message transmitted from the washing machine 10 is received by the controller 21 through the wireless communication unit 25. At this point, like a case of receiving the set laundry weight reach notifying message, whether the application 210 is opened is determined by the controller 21 (operation S48). Morever, when the application 201 is opened, the washing completion message is displayed on the display unit 27. On the contrary, when the application 201 is not opened, the message reception notification signal is generated (operation S50).

In addition, when the active washing is not selected, the application 201 allows a washing start selection button to be displayed on the display unit 27 of the mobile terminal 20 (operation S51). For example, a character message such as "start washing?" is displayed on the display unit 27, and buttons of "select" and "cancel" are displayed on a bottom portion of the display unit 27.

In detail, when the user touches the washing start selection button (operation S52), the controller 21 generates a washing start command to transmit the command to the controller 11 of the washing machine (operation S53). Then the controller 11 of the washing machine 10 receives the washing start command signal for allowing the washing machine 10 to start washing.

Like this, when the laundry weight detection period and active washing condition are selected by using the application installed in the mobile terminal 20 of the user, a signal is received by the washing machine 10 through the internet and the washing machine 10 may automatically perform the laundry weight detection and active washing according to the received signal. In addition, since the controller 11 of the washing machine 10 automatically transmits the set laundry weight reach notifying message and a message for asking the active washing start to the mobile terminal 20, the user may not only control the washing machine despite of positioning outside remotely but also not miss the washing period without paying attention to the washing.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

The invention claimed is:

1. A method for controlling a washing machine comprising a control panel, a wireless communication module configured to transmit and receive a signal through an internet connection, a driving unit with a driving motor, and a controller configured to control an operation of the driving unit, the method comprising:

setting a washing laundry weight that initiates laundry washing;

selecting an active washing cycle;

setting a laundry weight detection period;

storing, in the controller, washing condition information that includes the washing laundry weight, the laundry weight detection period, and the active washing cycle;

counting a period for detecting a laundry weight;

based on the laundry weight detection period elapsing, detecting a current laundry weight;

comparing the detected current laundry weight to the washing laundry weight;

based on determining that the current laundry weight satisfies the washing laundry weight, transmitting, through the internet connection and to a server for a washing control application, a notification message; and initiating the active washing cycle.

2. The method according to claim 1, wherein setting and storing of the washing condition information is performed using the washing control application that is installed in a user's mobile terminal, and wherein the washing condition information is transmitted to the server for the washing control application through the internet connection.

3. The method according to claim 2, wherein the washing control application is a mobile terminal control application that is executable in the user's mobile terminal.

4. The method according to claim 3, wherein the notification message is transmitted, through the internet connection, to the user's mobile terminal from the server for the washing control application.

5. The method according to claim 3, further comprising:

based the active washing cycle is not being selected, transmitting, through the internet connection and to the server for the washing control application, a query message asking whether to start washing.

6. The method according to claim 5, further comprising:

transmitting the query message asking whether to start washing together with a message notifying that the current laundry weight satisfies the washing laundry weight.

7. The method according to claim 5, further comprising:

transmitting the query message asking whether to start washing successively following the message notifying that the current laundry weight satisfies the preset laundry weight.

8. The method according to claim 5, further comprising:

based on receiving a washing start command signal from the server for the washing control application, controlling the driving unit to start the washing.

9. The method of claim 1, further comprising:

based on a set time lapsing after a start of washing to complete of the washing, transmitting, through the internet, a washing completion notifying message to the server for the washing control application.

10. The method according to claim 9, wherein transmitting the washing completion notifying message includes transmitting, through the internet, the washing completion notifying message to the user's mobile terminal from the server for the washing control application.

11. The method according to claim 10, further comprising:

displaying messages received by the user's mobile terminal from the server for the washing control application on a display unit of the mobile terminal.

12. The method of claim 6, further comprising:

displaying a washing start selection button on a display unit of the mobile terminal together with the query message asking whether to start washing; and based on the washing start selection button being selected by a user, generating a washing start command signal.

13. The method according to claim 12, further comprising transmitting the generated washing start command signal to the server for the washing control application through the internet connection.

14. The method of claim 8, further comprising:

based on a set time lapsing after a start of washing to complete of the washing, transmitting, through the internet connection, a washing completion notifying message to the server for the washing control application.

15. The method according to claim 14, wherein transmitting the washing completion notifying message includes transmitting, through the internet connection, the washing completion notifying message to the user's mobile terminal from the server for the washing control application.

16. The method according to claim 15, further comprising:

displaying messages received by the user's mobile terminal from the server for the washing control application on a display unit of the mobile terminal.

17. The method of claim 7, further comprising:

displaying a washing start selection button on a display unit of the mobile terminal together with the query message asking whether to start washing; and based on the washing start selection button being selected by a user, generating a washing start command signal.

18. The method according to claim 17, further comprising transmitting the generated washing start command signal to the server for the washing control application through the internet connection.

* * * * *